US006725856B1

(12) United States Patent
Barbour et al.

(10) Patent No.: US 6,725,856 B1
(45) Date of Patent: Apr. 27, 2004

(54) OUTDOOR GAS COOK STOVE WITH KNOCKDOWN LEGS

(75) Inventors: Rodney A. Barbour, Brandon, MS (US); Wayne Alvin Neal, Jackson, MS (US)

(73) Assignee: Barbour International, Inc., Brandon, MS (US)

( * ) Notice: Subject to any disclaimer, the term of this patent is extended or adjusted under 35 U.S.C. 154(b) by 0 days.

(21) Appl. No.: 10/248,818

(22) Filed: Feb. 21, 2003

Related U.S. Application Data

(60) Provisional application No. 60/319,121, filed on Feb. 25, 2002.

(51) Int. Cl.[7] ..... F24C 5/00

(52) U.S. Cl. ..... 126/50; 126/9 R; 126/40; 126/304 R

(58) Field of Search ..... 126/9 R, 9 A, 126/9 B, 29, 30, 38, 40, 50, 25 R, 304 R, 305, 304 A; 431/343

(56) References Cited

U.S. PATENT DOCUMENTS 668,902 A * 2/1901 Beyer ..... 126/40
1,697,175 A * 1/1929 Forshee ..... 126/40
2,515,521 A 7/1950 Loffredo
3,327,698 A * 6/1967 Leslie ..... 126/25 R
4,553,524 A * 11/1985 Wheat et al. ..... 126/25 R
4,587,947 A * 5/1986 Tomita ..... 126/25 R
4,885,988 A 12/1989 Lee
5,284,126 A * 2/1994 Varney ..... 126/50
5,452,706 A 9/1995 Meza
5,558,008 A 9/1996 Jenkins
5,640,949 A 6/1997 Smith
5,906,196 A 5/1999 Measom
6,123,015 A 9/2000 McLain et al.
6,314,955 B1 * 11/2001 Boetcker ..... 126/25 R
6,619,280 B1 * 9/2003 Zhou et al. ..... 126/39 R

* cited by examiner

*Primary Examiner*—James C. Yeung
(74) *Attorney, Agent, or Firm*—McGarry Bair PC

(57) ABSTRACT

A portable gas-fired cook stove is provided with readily assembled and disassembled legs, which facilitates shipping and storage of the cook stove. The legs are fastened to the stove body through a simple but very strong connection, which is capable of supporting loads well in excess of the weight of the cooking pot, food items, and cooking liquid. The cook stove can be disassembled and packaged with a nested cooking pot in a reduced-volume carton to reduce the space occupied by the carton during shipping and display.

22 Claims, 19 Drawing Sheets

OUTDOOR GAS COOK STOVE WITH KNOCKDOWN LEGS

CROSS REFERENCE TO RELATED APPLICATIONS

This application claims the benefit of U.S. provisional application Serial No. 60/319,121, filed Feb. 25, 2002, which is incorporated herein in its entirety.

BACKGROUND OF INVENTION

1. Field of the Invention

The invention relates to a gas-fired cooking apparatus. In one aspect, the invention relates to a portable gas stove having removable legs. In another aspect, the invention relates to a method of packaging a portable stove with removable legs.

2. Description of the Related Art

Outdoor cooking is an increasingly popular pastime. Traditional grilling on a charcoal grill has been supplanted by a variety of outdoor cooking techniques, many utilizing portable gas-fired cook stoves. One popular technique involves placing food items in a large cook pot containing oil or water which is heated by a portable cook stove supplied with a gas, such as propane, from a small cylinder. Such cooking assemblies have transformed typical backyard barbeque fare from hamburgers and hotdogs to deep-fried turkeys and boiled seafood dinners. The cooking of large food items, such as a turkey, or large quantities of a variety of food items, has given rise to larger cooking pots, which, when filled with the food items and the cooking liquid, can become quite heavy. The portable cook stove must consequently be capable of safely supporting such weight while the cook operates the device and handles the food being cooked therein. At the same time, the cook stove must be portable, relatively lightweight, and readily stored. Ideally, the cook stove must be capable of being easily disassembled for convenient storage and transportation, and reassembled for use.

Knock-down (or portable) cook stoves typically include removable legs. In addition to ease of storage, removable legs facilitate the shipping of a larger number of units in an ocean shipping container or truck. This lowers shipping costs and the ultimate cost of each unit. However, is consequently necessary for the end-user to attach the legs to the body of the cook stove.

Conventional cook stoves have legs attached to the body with a threaded connection such as a bracket which holds the legs to the body using small bolts or screws. The cook stove can be difficult and time-consuming to assemble, particularly if the fit and form of the threaded connections are poor. As well, the fasteners can rust over time, contributing to failure of the connection. Significantly, the load-bearing weight of the cook pot, food items, and cooking liquid is necessarily transferred to these small horizontal fasteners. If the legs are improperly installed, fasteners over-torqued, or if the fasteners have insufficient strength, the connection can fail, resulting in collapse causing fire, property damage, or personal injury due to contact with the hot cooking liquid.

SUMMARY OF INVENTION

A portable cook stove adapted for supporting a cooking pot thereon comprises a wall having a closed hoop configuration defining a periphery, wherein the wall defines a central opening therethrough, at least one cooking pot support mounted to the wall in a generally transverse orientation to the wall and extending into the central opening, the at least one cooking pot support defining a cooking pot support surface for supporting the cooking pot thereon, a burner mounted to the wall in a generally coaxial configuration with the central opening, the burner adapted to be operably interconnected with a source of fuel, a plurality of mounting portions mounted to at least one of the wall and the at least one cooking pot support in spaced locations around the periphery of the wall, and a plurality of ground-engaging legs connected to the mounting portions, wherein one of a lower surface of the wall and an upper portion of the plurality of legs has a mounting opening with a terminal end thereon adapted to receive the other of the lower surface of the wall and the upper portion of the plurality of legs when the plurality of legs are mounted to the mounting portions, and wherein the one of the lower surface of the wall and the upper portion of the plurality of legs can abut and receive reinforcement from the terminal end of the mounting opening when a force is imposed on the cooking pot support surface.

In one embodiment, the plurality of legs are inclined at a predetermined acute angle outwardly with respect to the wall so that a load on the cooking pot support surface will urge the legs to deflect angularly outwardly and provide additional support to the portable cook stove and a more stable base for the cooking pot to prevent tipping thereof. In another embodiment, the mounting portions further comprise nuts and the plurality of legs are threaded coaxially therein. The plurality of legs can further comprise a shoulder which receives a bottom edge of the wall, or flanges with mounting apertures therethrough, which are attached to the wall via fasteners extending through the mounting apertures. A lower edge of the wall can have a groove in register with each of the plurality of the ground-engaging legs and the mounting portion can be received within the groove to minimize side-to-side and rocking movement of the corresponding leg with respect to the wall.

In another embodiment, the mounting opening and the terminal end are on the legs and comprise a v-shaped opening having a shoulder. The wall can have a rounded rectangular shape or be circular.

In another embodiment, the at least one cooking pot support is a v-shaped brace mounted to an interior surface of the wall. In yet another embodiment, the wall can have top and bottom edges, wherein the wall engages each of the plurality of legs at a point intermediate the top and bottom edges whereby the engagement resists the outer deflection of each of the plurality of legs during loading of the portable cook stove. The burner can also be positioned at the mid-height of the wall to maximize the diversion of wind away from the burner.

The invention also relates to a method of packaging a portable cook stove comprising the steps of providing a carton of a predetermined size, providing a portable cook stove in a disassembled state comprising a wall having a closed hoop configuration having a top edge and a bottom edge and defining a central opening therethrough having a plurality of cooking pot supports mounted to the wall adjacent the top edge thereof and extending into the central opening, a plurality of legs, a cooking pot defining a cooking chamber therein, a burner adapted to be mounted to the wall, and hardware for attachment purposes, inverting the wall so that the cooking pot supports comprise a floor portion adjacent the bottom edge of the inverted wall, placing the inverted wall inside the carton, placing the cooking pot within the central opening inside the inverted wall atop the cooking pot supports, placing the legs, the burner, and the hardware inside the cooking chamber of the cooking pot, and closing the carton, whereby the carton can be sealed and shipped to a desired location and the packaged portable cook stove occupies less space than a portable cook stove packaged utilizing conventional packaging methods.

The method can further comprise the steps of placing packing materials around the components in the carton to prevent damage to the components in the carton during shipping, unpacking the carton and assembling the portable cook stove, and loading a plurality of cartons packaged according to the invention into a standard shipping container for delivery.

DETAILED DESCRIPTION

Figure 1:
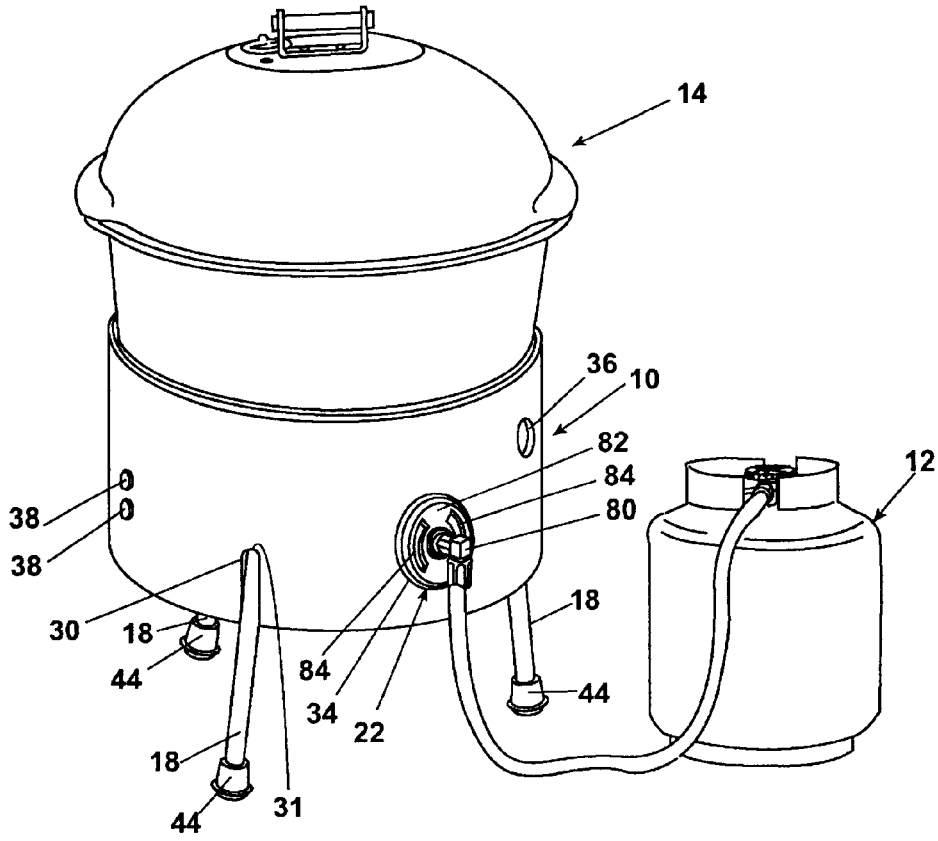
FIG. 1 is a perspective view of a portable cook stove comprising removable legs illustrating a first embodiment of the invention connected to a gas supply and supporting a cooking pot.

Referring to FIG. 1, a portable gas cook stove 10 according to the invention is connected to a supply of gas, such as a portable propane gas cylinder 12. The gas cook stove 10 supports a cooking pot 14 containing selected food items and a cooking liquid, such as oil or water, for cooking the food items.

Figure 2:
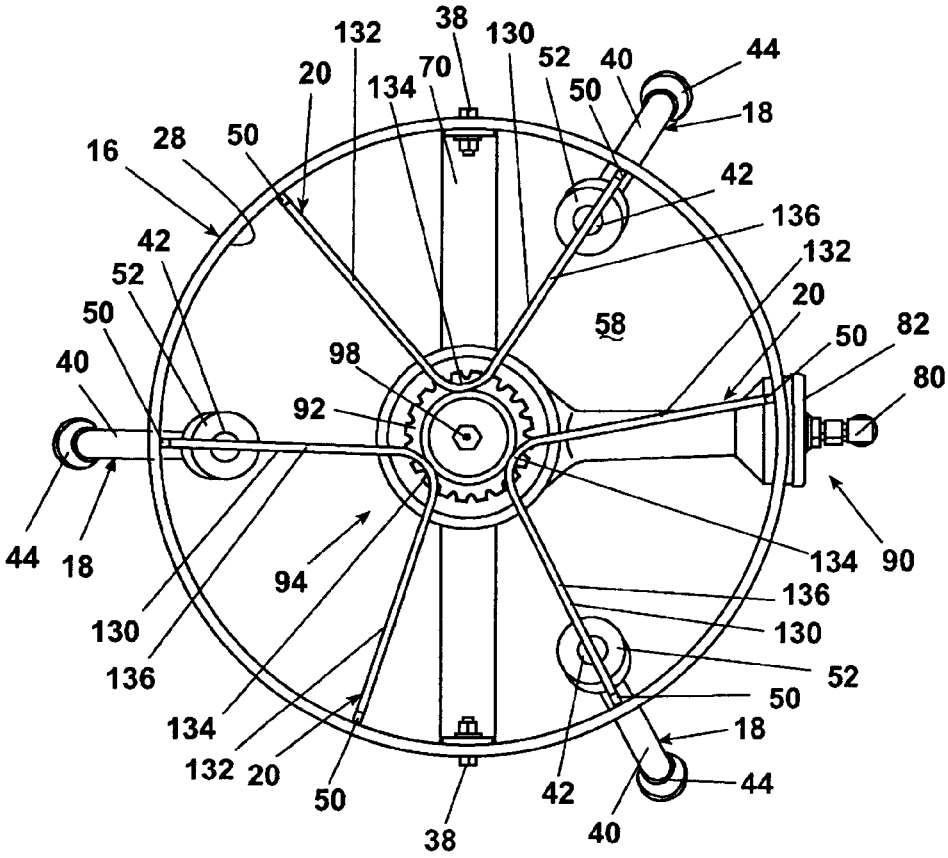
FIG. 2 is a plan view of the portable cook stove of FIG. 1.
Figure 4:
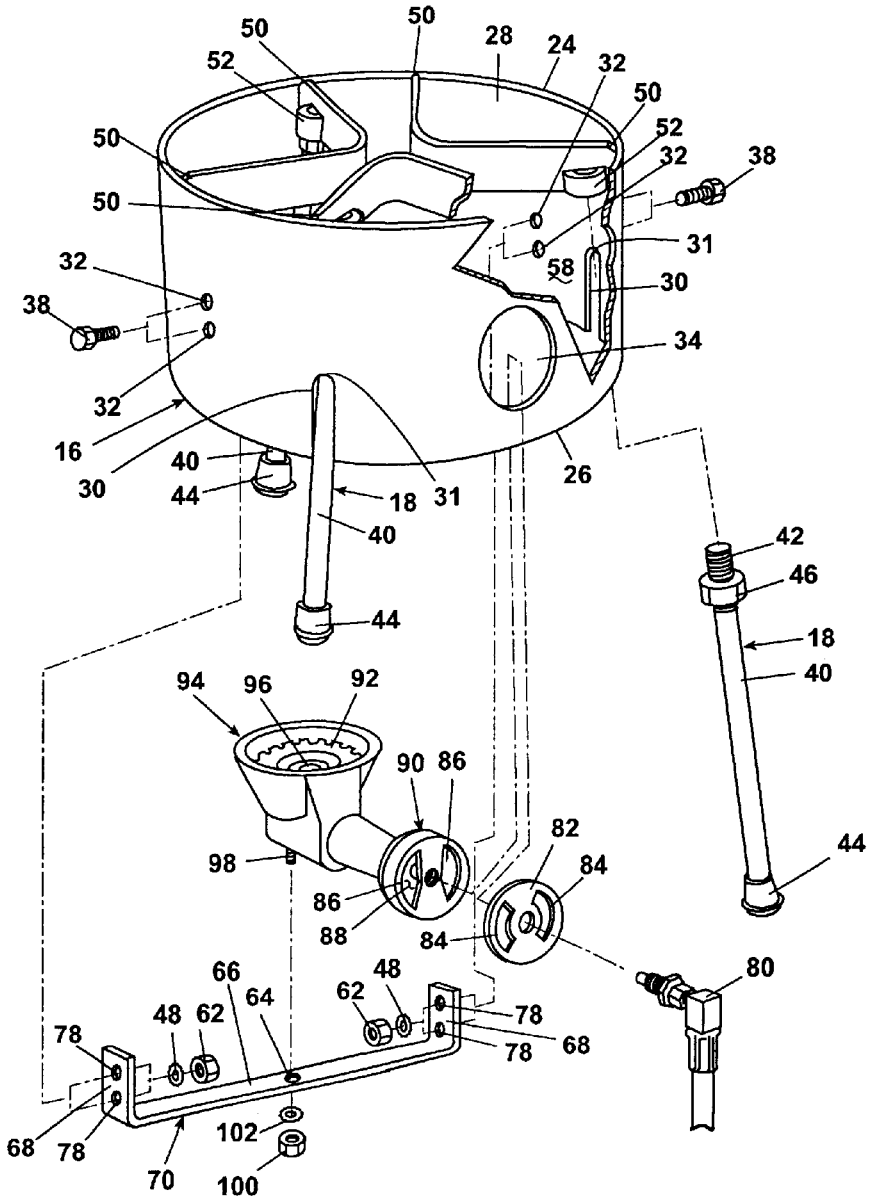
FIG. 4 is an exploded view of the portable cook stove of FIG. 1.

Referring now to FIGS. 2 and 4, the gas cook stove 10 comprises a circular windband hoop 16 supported on three removable legs 18, three pot supports 20, and a venturi-type gas burner 22. In the preferred embodiment, the hoop 16 comprises a generally rectangular 3.2 mm thick flat steel plate, 6 inches wide, which is formed, preferably by welding, into a cylindrical, open-ended body having a peripheral wall defining a center opening 58 therethrough, and having a diameter of 14 inches, with a top edge 24, a bottom edge 26, and an inside surface 28.

The hoop 16 is provided with three leg slots 30 extending upwardly from the bottom edge 26, preferably having a length of 2⅝ inches, and terminating in a terminal end 31. The slots 30 are preferably ¾-inch in width, but can be any width suitable to slidably receive a removable leg 18 as hereinafter described. The slots 30 are spaced around the hoop 16 at 120 degrees. The hoop 16 is also provided with two pair of diametrically-opposed burner support bar-apertures 32, each of which receives, in the preferred embodiment, a ⅜-inch hex head bolt 38. Preferably, the apertures 32 in each pair are vertically spaced 1 inch on center. The hoop 16 also comprises a circular burner aperture 34 preferably having a diameter of three inches centered approximately 2½ inches above the bottom edge 26. A lighting aperture 36 having a diameter of approximately one inch is located approximately 1⅞ inches below the top edge 24.

In the preferred embodiment, each leg 18 comprises a ⅝-inch diameter solid round steel rod 40 approximately 12¾ inches long. A first end 42 of the rod 40 is threaded. A second end of the rod 40 slidably receives a rubber tip 44 or a round metal cap. The tip 44 can be frictionally fit onto the leg 18, or secured such as with an adhesive or welding. A lock nut 46 is threaded onto the threaded end 42.

In the preferred embodiment, the cook stove 10 comprises three pot supports 20, comprising generally rectangular 4.15 mm thick flat steel plate having a width of 1½ inch and a length of approximately 12½ inches. Alternatively, the pot supports 20 can comprise round steel bar. Each support 20 is formed into a generally V-shaped member or brace having a first leg 130 approximately 5½ inches long and a second leg 132 approximately 5½ inches long to define an angle of 72 degree with an intervening bight section 134 having a radius of ¾ inch. Each support 20 has an upper edge 136 and a lower edge 138. The first leg 130 terminates in an end 140, and the second leg 132 terminates in an end 142 which are attached to the hoop 16 as hereinafter described. The legs 130, 132 are beveled 45° at a corner 50 extending from the upper edge 136 to the respective ends 140, 142. The height of the bevel is preferably 7/16 inch. The supports 20 are spaced around the hoop 16 at 120 degrees.

Figure 3:
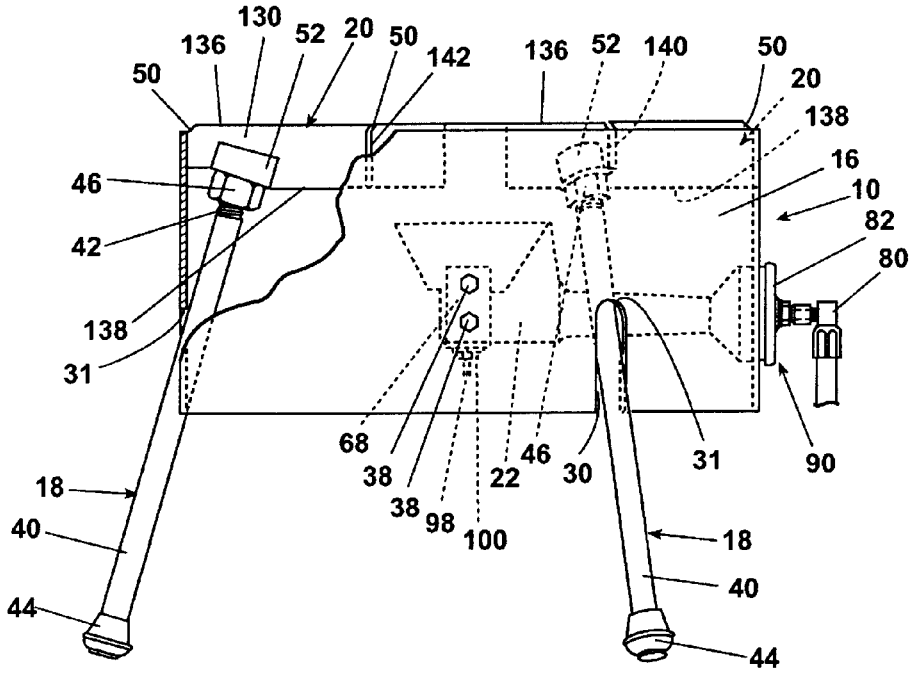
FIG. 3 is a side elevational view of the portable cook stove of FIG. 1 with a portion of the stove body cut away to show a connection of a leg to the stove body.
Figure 3A:
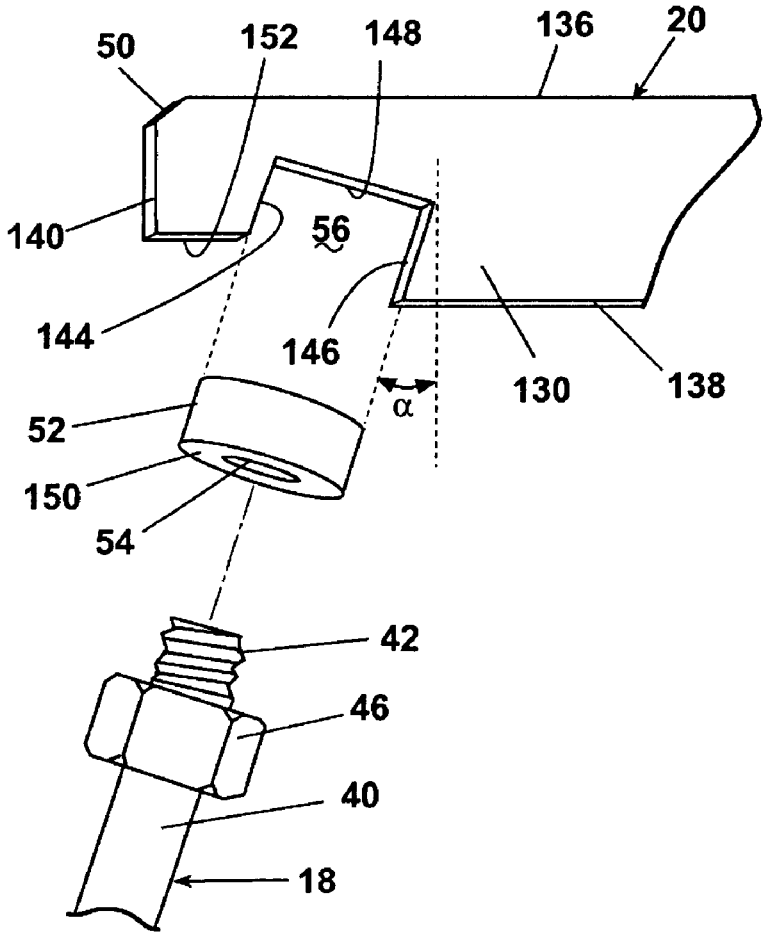
FIG. 3A is an exploded close-up view of the connection of FIG. 3.

As shown in FIGS. 3 and 3A, the first leg 130 of each support 20 is provided with a spacer cutout 56 comprising an inclined notch extending upwardly from the lower edge 138. The cutout 56 is inclined away from the end 140 an angle preferably of approximately 20 degrees, identified in FIG. 3A as "α." The cutout 56 comprises an outer edge 144 and an inner edge 146 in parallel, spaced-apart relationship, and an upper edge 148 orthogonal to the edges 144, 146 to define the rectilinear cutout 56 having a generally square or rectangular profile. The preferred embodiment comprises a leg spacer 52 comprising a toroidal-shaped or hex-shaped-piece having a diameter of 1½ inch and a height of ¾ inch, a circumferential edge 150, and a threaded aperture 54 axially therethrough for threaded communication with the threaded end 42 of the rod 40. The spacer cutout 56 slidably receives the leg spacer 52 so that a diameter of the spacer 52 is aligned with the plane of the first leg 130. The length of the edges 144, 146 is generally equal to the height of the spacer 52. Each leg end 140, 142 is rigidly attached to the inside surface 28, preferably by welding along the interface of the end 140, 142 and the inside surface 28 on both sides of the leg 130, 132. The spacer 52 is rigidly attached to the cutout 56, preferably by welding along the interface of the spacer 52 and the edges 144, 146 on both sides of the leg 130.

Figure 10:
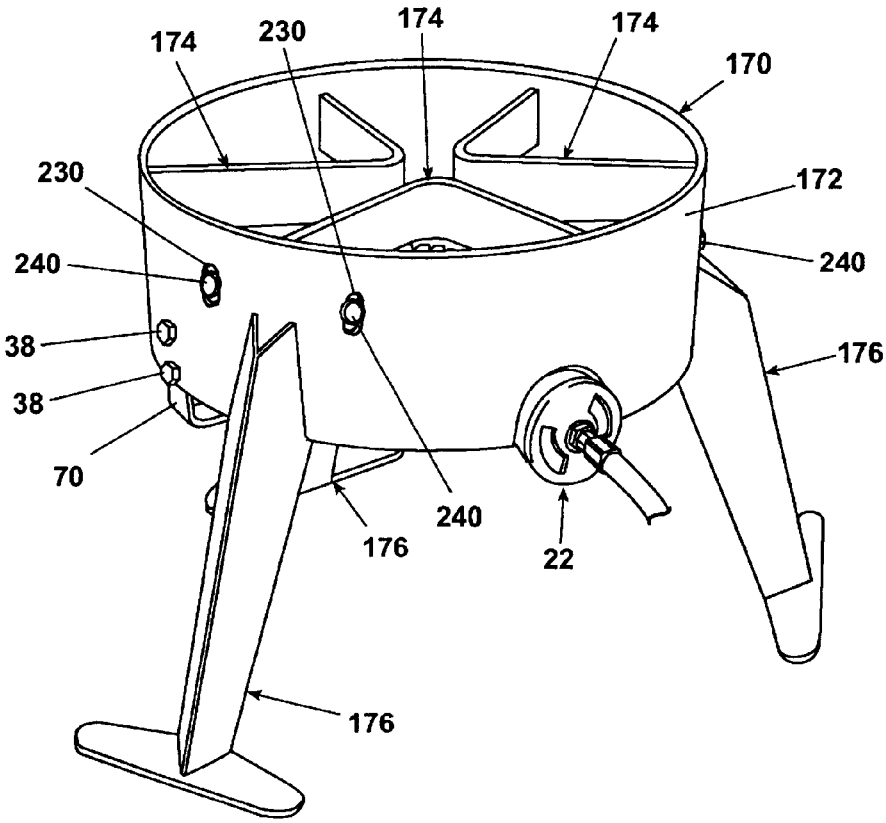
FIG. 10 is a perspective view of a third embodiment of the invention comprising the portable cook stove of FIG. 2 and an alternate embodiment of the removable legs.
Figure 12:
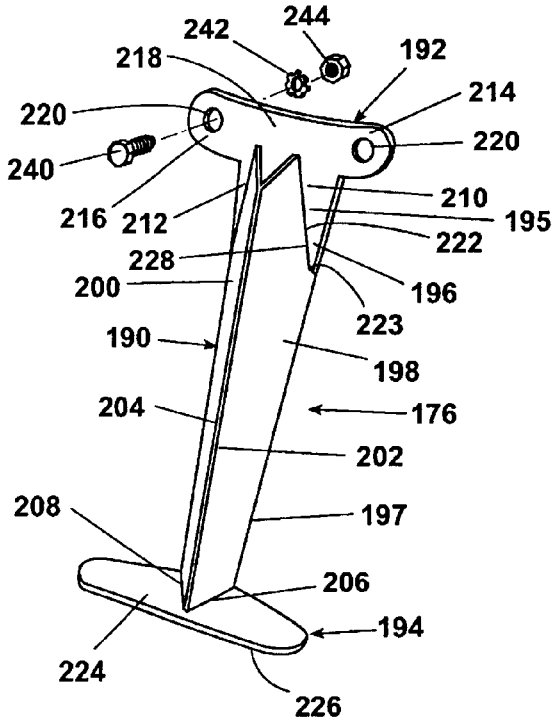
FIG. 12 is a perspective view of one of the legs shown in FIG. 10.
Figure 11:
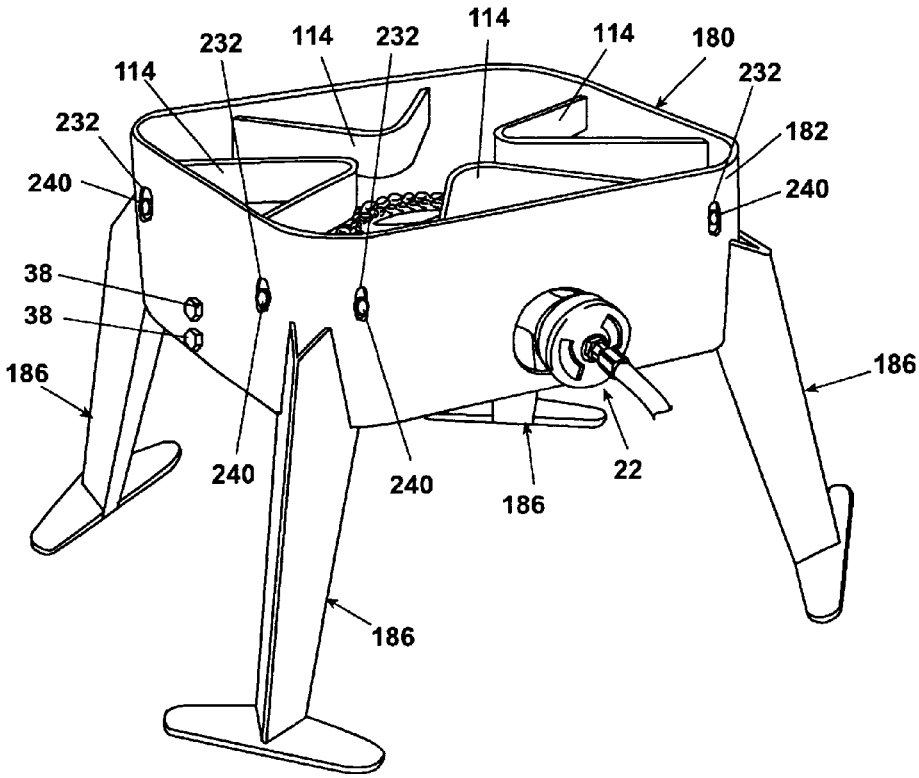
FIG. 11 is a perspective view of a fourth embodiment of the invention comprising the portable cook stove of FIG. 5 and an alternate embodiment of the removable legs.
Figure 13:
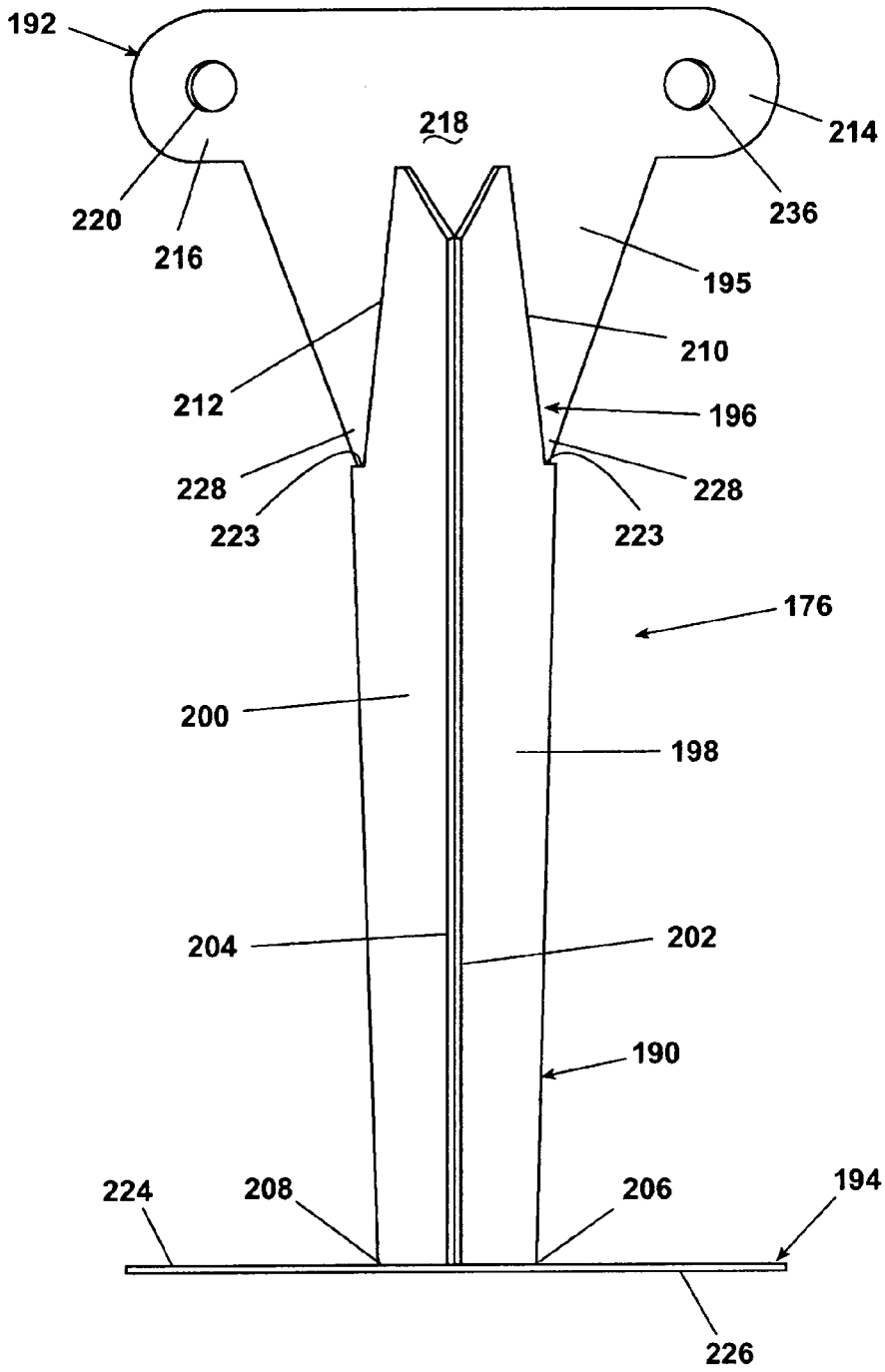
FIG. 13 is a front elevational view of the leg shown in FIG. 12.

Preferably, the spacer 52 does not extend beyond the lower edge 138. Preferably, a portion of the leg 130 between the spacer 52 and the end 140 is removed to provide a shortened lower edge 152 offset from and parallel to the lower edge 138 extending from the circumferential edge 150 to the end 140 so that the spacer 52 does not extend beyond the shortened lower edge 138. The length of the shortened lower edge 138 is approximately ½ inch, thereby positioning the spacer circumferential edge 150 approximately ½ inch from the inside surface 28. Each support 20 is positioned around the circumference of the hoop 16 so that each leg 18 can extend through a slot 30 and threaded into the spacer 52, contacting the terminal end 31 of the corresponding slot 30. The supports 20 are attached to the hoop 16 so that the support upper edge 136 extends above the hoop top edge 24 approximately 7/16 inch, and each bight section 134 extends radially inwardly toward the center of the hoop 16 above the burner 22. Alternatively, the supports 20 can be attached to the hoop 16 so that the support upper edge 136 extends below the hoop top edge 24 to prevent a smaller cook pot from sliding or being moved off the cook stove 10, as shown in FIGS. 10 and 11.

Referring to FIG. 4, a burner support bar 70 comprises a generally rectangular 4.15 mm thick flat steel plate having a width of approximately one inch. The burner support bar 70 comprises a support portion 66 terminating in two mounting flanges 68 in parallel, spaced-apart relationship orthogonal to the support portion 66 at either end thereof. The length of the support bar 70 is generally equal to the inside diameter of the hoop 16. Each mounting flange 68 is provided with a pair of apertures 78 corresponding to the burner support bar apertures 32 for receiving the bolts 38 therethrough. In the preferred embodiment, the burner support bar 70 is attached to the hoop 16 by inserting the bolt 38 through each burner support bar aperture 32 and corresponding flange aperture 78, and securing the bolt 38 with a conventional lock washer 48 and hex nut 62. The midpoint of the support bar 70 is also provided with a burner mounting aperture 64 therethrough.

In the preferred embodiment, the cook stove 10 is provided with a conventional venturi-type gas burner 22 comprising a generally irregularly-shaped, hollow member. Alternatively, other gas burners or heat sources, such as electrical heating elements, can be used. The gas burner 22 is provided with a conventional gas line connection 80 at a gas inlet end 90 for connecting the burner 22 to a gas supply 12, as shown in FIG. 1, and a generally circular gas combustion end 94 for supplying heat to a cooking container, such as the cooking pot 14. The gas inlet end 90 comprises an air/gas mixing chamber 88 having a pair of diametrically-opposed air inlet slots 86. The burner 22 is mounted in the hoop 16 so that the gas combustion end 94 is coaxial with the hoop 16 and centered over the burner mounting aperture 64, with the gas inlet end 90 extending radially therefrom through the burner aperture 34 . An air inlet plate 82 comprises a generally circular plate having a pair of diametrically-opposed air inlet slots 84. The air inlet plate 82 is rotatably attached to the gas inlet end 90 through a suitable connection (not shown), such as a threaded connection, so that the air inlet plate 82 can be rotated in order to either align or offset the air inlet slots 84 with the air inlet slots 86 in order to control the flow of air into the burner 22. A mounting bolt conduit 96 extends through the gas combustion end 94 coaxial therewith for receiving a mounting bolt 98 for attaching the burner 22 to the burner support bar 70 through the burner mounting aperture 64 using a nut 100 and a lock washer 102.

The cook stove 10 is assembled by an end user by first attaching the burner support bar 70 to the hoop 16 using the bolts 38, the nuts 62, and the lock washers 48. Preferably, the burner support bar 70 is attached to the hoop 16 so that the flanges 68 extend upwardly. The burner 22 is attached to the burner support bar 70, after first inserting the inlet end 90 through the burner aperture 34 by inserting the mounting bolt 98 through the mounting bolt conduit 96 and the burner mounting aperture 64, using the nut 100 and lock washer 102. The legs 18 are then threaded into the leg spacers 52 to extend into the center opening 58 and the lock nuts 46 are tightened against the spacers 52 to rigidly secure the legs 18 into the spacers 52. The legs 18 will be inclined from the vertical approximately 20 degrees to extend outwardly of the hoop 16 through the leg slots 30, and will contact the terminal ends 31 of the leg slots 30.

The legs 18 can be adjusted to accommodate an uneven support surface by turning each leg 18 inwardly or outwardly as necessary to level the cook stove 10. Tightening the locknut 46 against the spacer 52 will maintain the legs 18 at the proper length and the cook stove 10 in the level position.

A cooking pot 14 containing food items and cooking liquid is placed on the supports 20. The cook stove 10 can accommodate a pot having a diameter greater than the diameter of the hoop 16 since the pot will be supported above the hoop 16 due to the elevation of the upper edge 136 of the supports 20 above the top edge 24 of the hoop 16. The weight of the pot 14 is transferred directly from the supports 20 through the leg spacers 52 and into the legs 18. None of the weight of the pot 14 is carried by the hoop 16 or by any of the bolted connections. If placement of the pot 14 on the cook stove 10 should urge the legs 18 outwardly, the outward movement of the legs 18 will be resisted by contact of the legs 18 with the terminal ends 31 of the slots 30.

The burner 22 is lighted by turning on the gas from the gas supply 12 and passing a long match or other lighting implement through the lighting aperture 36. The flame can be adjusted by rotating the air inlet plate 82 to align or offset the slots 84 with the slots 86.

Figure 5:
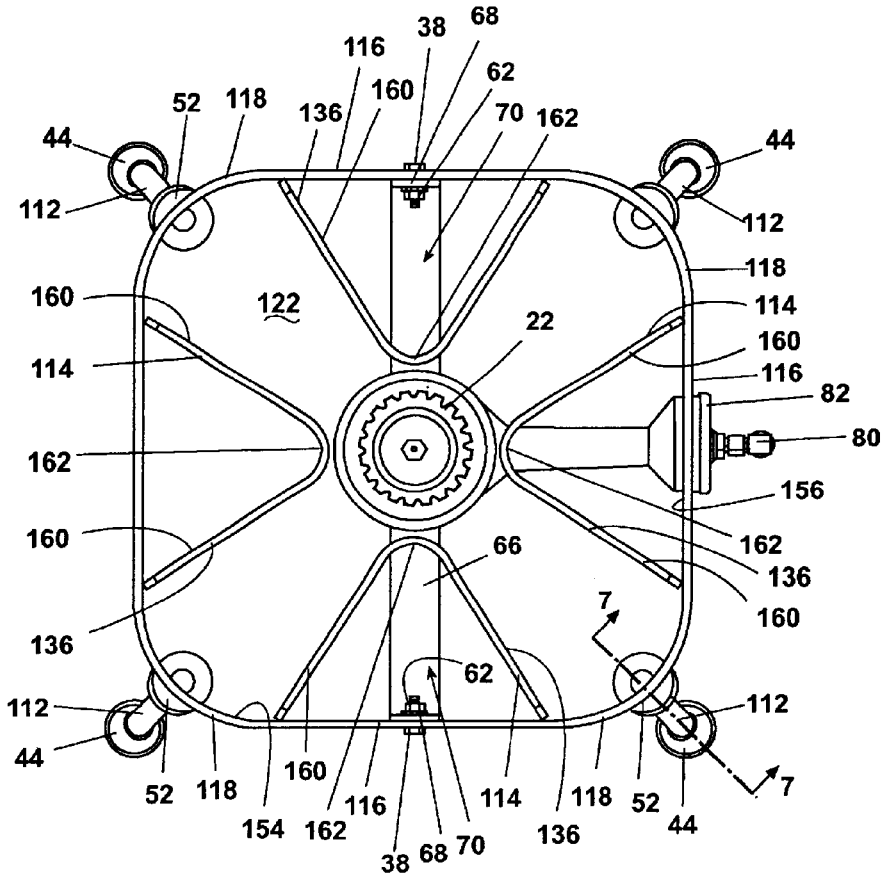
FIG. 5 is a plan view of a portable cook stove illustrating a second embodiment of the invention.
Figure 6:
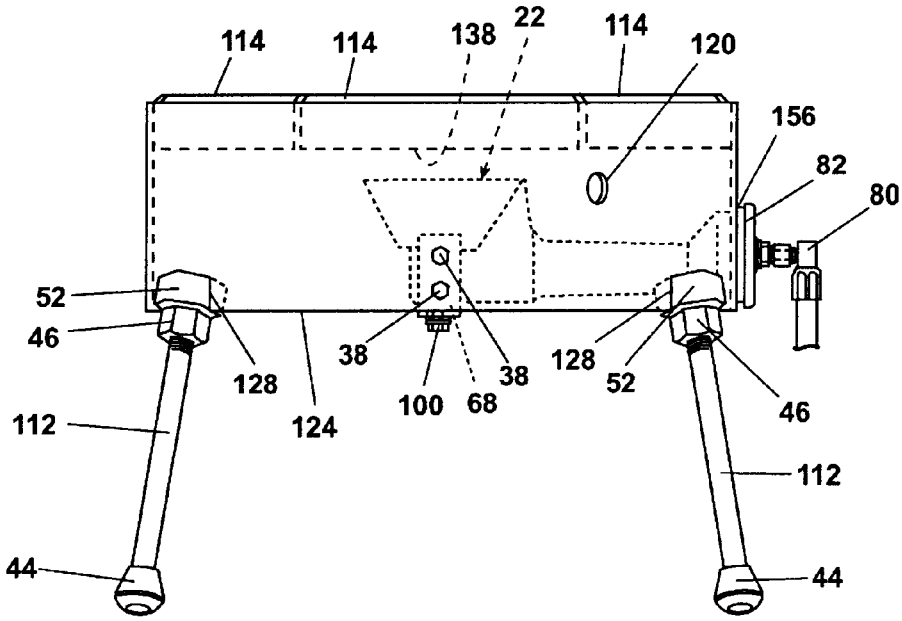
FIG. 6 is a side elevation view of the portable cook stove of FIG. 5.
Figure 7:
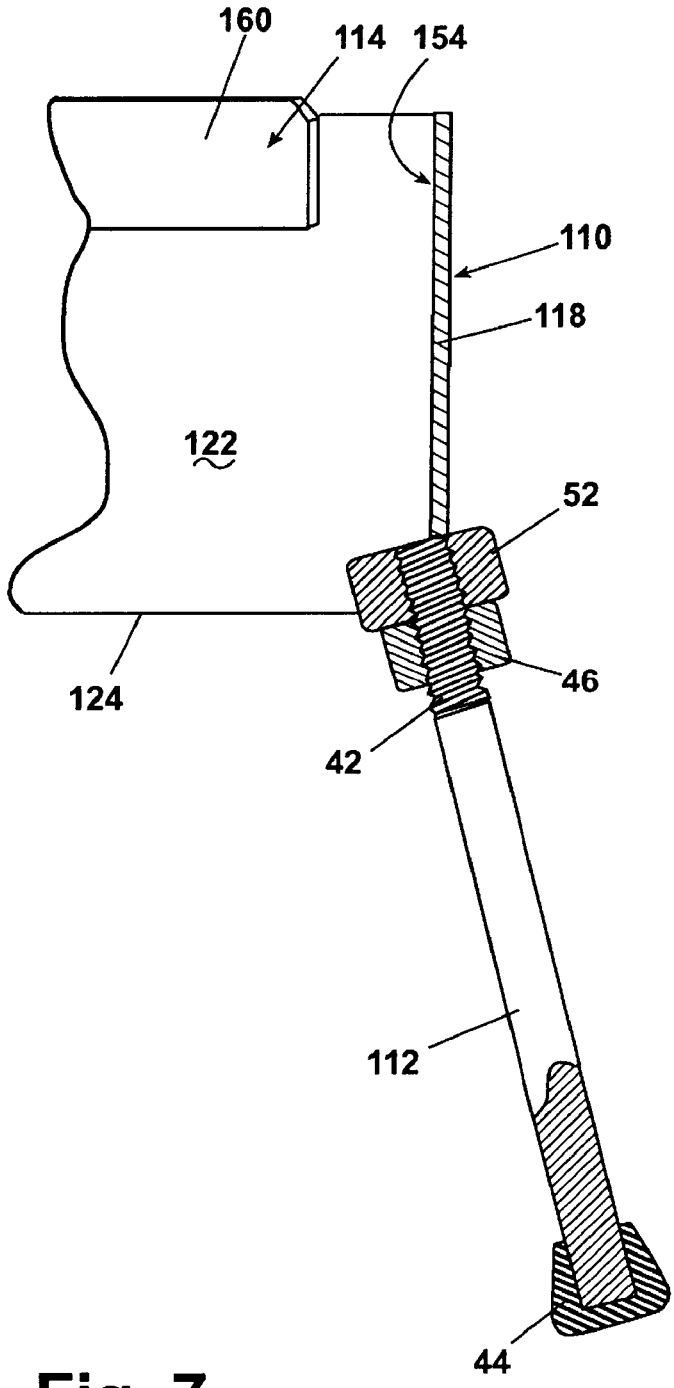
FIG. 7 is a sectional view taken along line 7—7 of FIG. 5.

FIGS. 5–7 illustrate a portable gas cook stove 108 illustrating a second embodiment of the invention, which is identical in most respects to the first embodiment 10 described herein. The embodiments differ only in the shape of the hoop, the number of pot supports, and the number, length, and placement of the legs. Thus, like numerals will be used for like elements. Both embodiments comprise a venturi-type burner, a burner support bar, legs having a threaded end with a threaded lock nut, threaded spacers for threading of the legs therein, and a hoop having a lighting aperture, a burner aperture, and mounting apertures therethrough.

Referring to FIGS. 5 and 6, the second embodiment comprises a generally square hoop 110 having four legs 112 and four pot supports 114 comprising identical V-shaped members. The cook stove 108 also comprises a conventional venturi-type burner 22 and burner support bar 70 generally the same as for the first embodiment 10 of the invention.

The hoop 110 comprises a generally rectangular 3.2 mm thick flat steel plate having a 6-inch width, which is fabricated, preferably by welding, into a generally square-shaped body approximately 14 inches square having a peripheral wall defining a center opening 122 therethrough, comprising four straight walls 116 joined by four curved walls 118, and having an inside surface 154 and a bottom edge 124. One of the straight walls 116 is provided with a burner lighting aperture 36, preferably one inch in diameter. Two opposing walls are provided with burner support bar apertures 32 for attaching a burner support bar 70 generally as for the first embodiment 10. One of the straight walls 116 orthogonal to the walls 116 having the burner support bar apertures 32 is also provided with a burner aperture 156 for receipt of a heating element therethrough, such as the venturi burner 22 shown in the first embodiment. Preferably, the burner aperture 156 has a diameter of 2¼ inch.

Each pot support 114 comprises a generally rectangular 4.15 mm thick flat steel plate, having a width of 1¼ inch, which is formed into a V-shaped member or brace generally as for the support 20 described with respect to the first embodiment 10. Each support 114 comprises a pair of equal-length legs 160 connected by a bight section 162 and forming an angle of approximately 65 degrees. The upper corner of each leg 160 is finished off at a 45° bevel, approximately 7/16 inch in height. Each support 114 is rigidly attached to the inside surface 154 of a straight wall 116, preferably by welding, so that the pot support 114 extends above the top edge of the hoop 110 approximately 7/16 inch.

Referring to FIG. 7, a spacer cutout 128 is provided at the bottom edge 124 at each corner of the hoop 110 for receiving the leg spacer 52. Alternatively, a conventional threaded nut can be used as the spacer 52. The leg spacer 52 is inserted into the cutout 128 and welded to the hoop 110 by running a weld around the spacer 52 along the edge of the cutout 128 on each side of the hoop 110 so that its axis is inclined outwardly of the hoop 110 15 degrees from the vertical. The spacers 52 are also oriented in the cutouts 128 so that the wall of the hoop 110 intersects a portion of the threaded aperture 54, thus preventing the leg 112 from being threaded past the top of the spacer 52.

The legs 112 each comprise a ⅝-inch diameter solid round steel rod approximately 8 inches long. A first end 42 of the leg 112 is threaded. A second end of the leg 112 slidably receives a rubber tip 44. The tip 44 can be frictionally fit onto the leg 112, or secured with an adhesive. A lock nut 46 is threaded onto the threaded end 42. The legs 112 are attached by threading the legs 112 into the spacer 52 and locking the leg 112 in place with the lock nut 54. The legs 112 will thus be inclined outwardly of the hoop 110 approximately 15 degrees from the vertical. The burner support bar 70 is attached to the hoop 110 by passing the bolts 38 through the support bar apertures 32 and flange apertures 78, and securing the bolts 38 with the lock washers 48 and the nuts 62. The burner 22 is attached to the burner support bar 70 as for the first embodiment with the gas inlet end 90 protruding through the burner aperture for connection to the gas supply 12.

Figure 8:
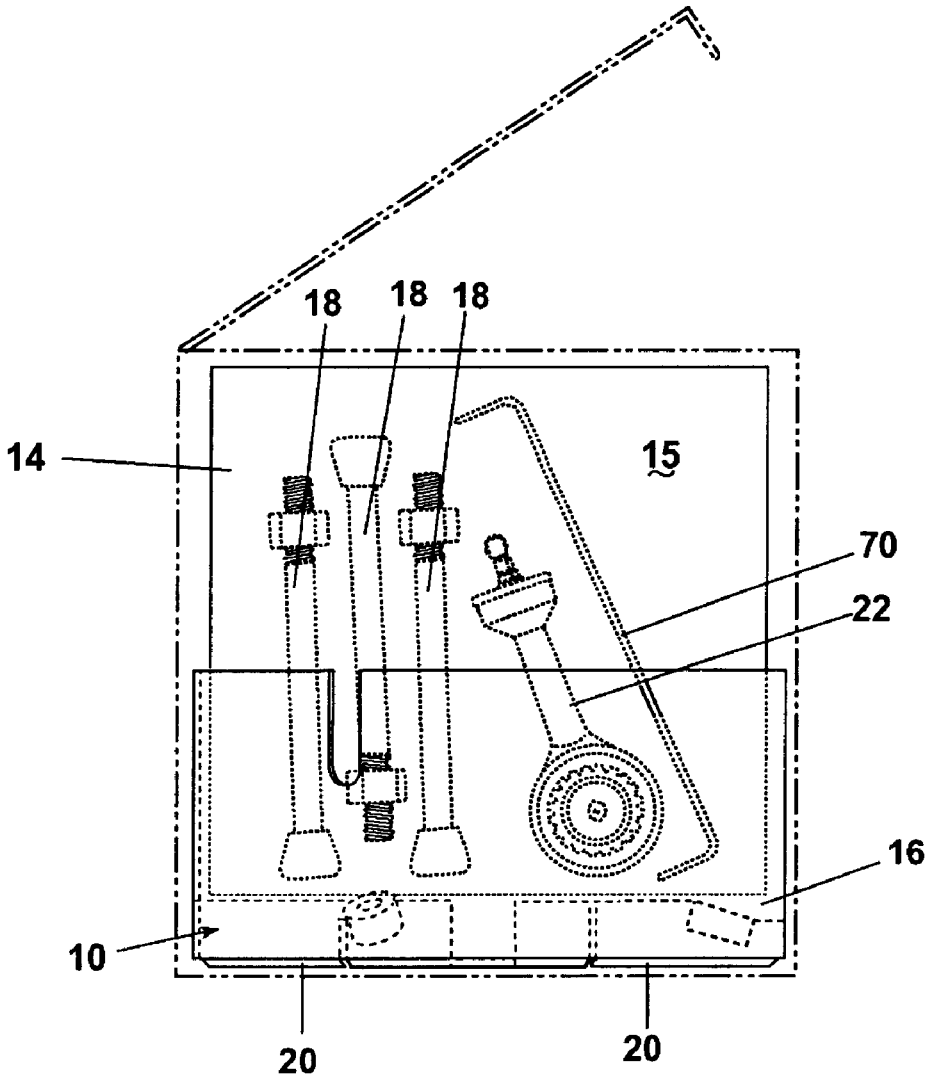
FIG. 8 is a side elevational view of the portable cook stove of FIG. 1 disassembled and packaged with a cooking pot in a shipping carton.

The advantages of this unique burner assembly are ease of assembly, strength, stability, and shipping convenience. The burner support bar 70 is easily attached by the end user to the hoop 16, 110 and carries no weight through any of its bolted connections. The burner 22 is easily assembled by the end user onto the burner support bar 70 which enables the burner 22 to be supplied separated from the hoop 16, 110 for convenience in shipping. The legs 20, 112 can also be shipped separated from the hoop 16, 110 to provide a compact shipping package. As shown in FIG. 8, the legs, burner, and burner support bar can be shipped inside the cooking chamber 15 of a cooking pot 14 which is, in turn, inserted into the inverted hoop 16, 110 for shipping in a carton for retail sale to customers. The compact shipping configuration also affects the number of units that can be shipped from the manufacturer. The number of cook stove/cooking pot combination sets that can be carried by a standard shipping container is approximately twice that of sets using a prior art design. As shown in FIG. 8, packing the cooking pot 14 inside the hoop 16, 110 also reduces the potential for damage to the pot 14 during shipping.

Figure 9:
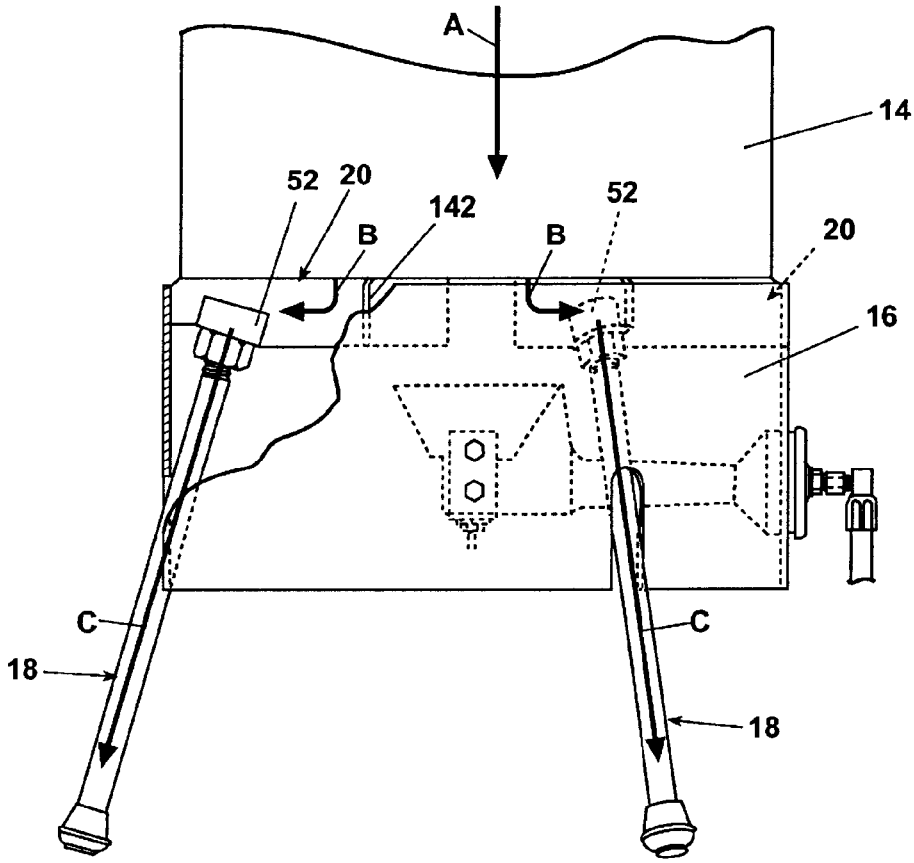
FIG. 9 is a side elevational view of the cook stove of FIG. 1 with a schematic representation of the distribution of the load through the stove imposed by a cooking pot containing food items and cooking liquid.

As shown in FIGS. 3, 3A, 6, and 7, the legs 18, 112 are easily threaded into the spacer 52 by the end-user to form a strong connection thereby avoiding the hazards associated with improper mounting of the legs to the frame, as can occur with a bolted connection. As shown in FIG. 9, the unique design of the leg-to-frame connection provides significant strength and load carrying capacity. As an example, with the circular hoop 16, the load (designated as "A" in FIG. 9) from a cooking pot 14 containing food items and a cooking liquid will be distributed (designated as "B" in FIG. 9) along the supports 20 through the spacer threaded connection and axially down the legs 18 (designated as "C" in FIG. 9). In a similar manner, with the square hoop 110, the load from a cooking pot 14 containing food items and a cooking liquid will be distributed along the supports 114 into the hoop 110 through the welded connections between the supports 114 and the hoop 110, along the hoop walls 116, 118, through the spacer threaded connection and axially down the legs 112.

With both embodiments, the load is borne entirely by essentially rigid connections (i.e. welding or threaded). Furthermore, the prior art bolted connections are subjected to potentially large shear stresses which can cause failure if the connections are not properly made or are weakened due to corrosion or rust. With the subject cook stove, the threaded connections carry the load axially, rather than transversely, essentially eliminating shear stresses across the threaded connection, and the connecting elements (i.e. the spacer, the threaded end, and the leg) have a relatively large section, providing increased strength over the prior art bolted connections. The leg strength and the inclination of the legs relative to the hoop result in an extremely stable structure, minimizing the potential for overturning of the cookstove and cooking pot, thereby contributing to improved safety. Finally, the unique design of the cook stove makes it virtually impossible to improperly assemble the legs to the hoop. If the legs are somehow improperly assembled, the cook stove will not be properly supported on the legs, thereby preventing its use. With either the three-leg or four-leg design, the failure of a leg to be securely threaded into the spacer will render the cook stove unstable and unusable.

The height of the hoop 16, 110 provides increased wind protection for the burner 22. As shown in FIGS. 3 and 6, the burner 22 is positioned essentially-at the mid-height of the hoop 16, 110. Thus, the hoop 16, 110 extends approximately 3 inches above and below the burner 22. The presence of the cooking pot 14 acts as a further shield against wind over the top of the hoop 16, 110. The extension of the hoop 16, 110 below the burner 22, and the use of relatively short legs, also limit the wind effect from below the hoop 16, 110. This configuration mitigates the effects of the wind, and contributes to more controlled heating, a hotter flame, efficient gas use, and more satisfactory cooking results. Additionally, the use of short legs contributes to a cook stove having a low center of gravity, enhancing the stove's stability against overturning, and facilitating the use of tall, high volume cooking pots.

An alternate embodiment of the legs is illustrated in FIGS. 10–17. FIG. 10 illustrates the legs supporting a circular windband hoop 172 similar to the windband hoop 16 shown in FIGS. 2 and 3. FIG. 11 illustrates the legs supporting a square hoop 182 similar to the square hoop 110 shown in FIGS. 5 and 6. The embodiments shown in FIGS. 10–17 differ from the embodiments shown in FIGS. 1–9 in the configuration of the hoops and the pot supports, and the structure and attachment of the legs. However, like numerals will be used for like elements between these embodiments. All the embodiments comprise a gas burner, a burner support bar, and a hoop having a lighting aperture, a burner aperture, and mounting apertures therethrough.

Referring now to FIG. 10, in light of FIGS. 3 and 4, a gas cook stove 170 comprises a circular windband hoop 172, a plurality of pot supports 174, and a burner 22 supported by a burner support bar 70 attached to the windband hoop 172 through bolts 38, assembled generally as for the cook stove 10 shown in FIG. 3, and supported by a plurality of legs 176. The hoop 172 is identical to the hoop 16 except that the leg slots 30 are omitted in the hoop 172, and a plurality of vertically-oriented, suitably-sized mounting slots 230 extending through the hoop 172 are provided for attaching the legs 176 to the hoop 172 with conventional fasteners, such as a threaded bolt 240, a lock washer 242, and a threaded nut 244. The pot supports 174 are identical to the pot supports 20 except that the spacer cutouts 56 are omitted in the pot supports 174.

Referring now to FIG. 11, in light of FIGS. 6 and 7, a gas cook stove 180 comprises a square hoop 182, a plurality of pot supports 114, and a burner 22 supported by a burner support bar 70 attached to the square hoop 182 through bolts 38, assembled generally as for the cook stove 108 shown in FIG. 6, and supported by a plurality of legs 186. The square hoop 182 is identical to the square hoop 110 except that the spacer cutouts 128 are omitted in the square hoop 182, and a plurality of vertically-oriented, suitably-sized mounting slots 232 extending through the hoop 182 are provided for attaching the legs 186 to the hoop 182 with conventional fasteners, such as a threaded bolt 240, a lock washer 242, and a threaded nut 244.

Figure 16:
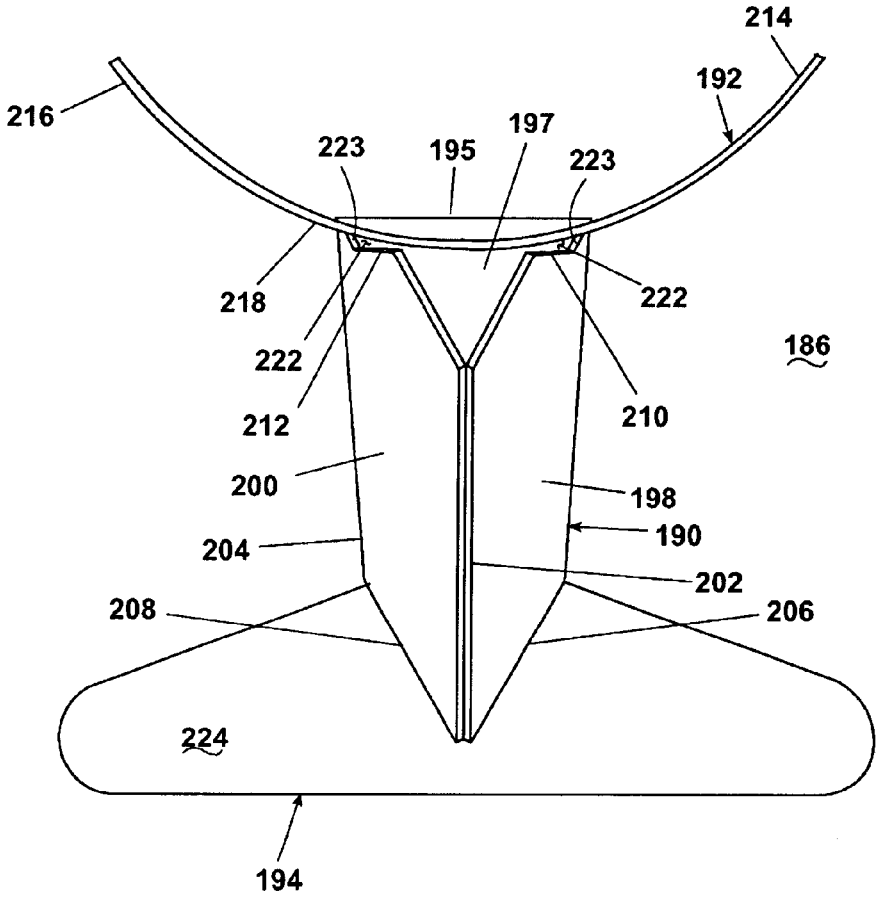
FIG. 16 is a top plan view of the leg shown in FIG. 12.
Figure 17:
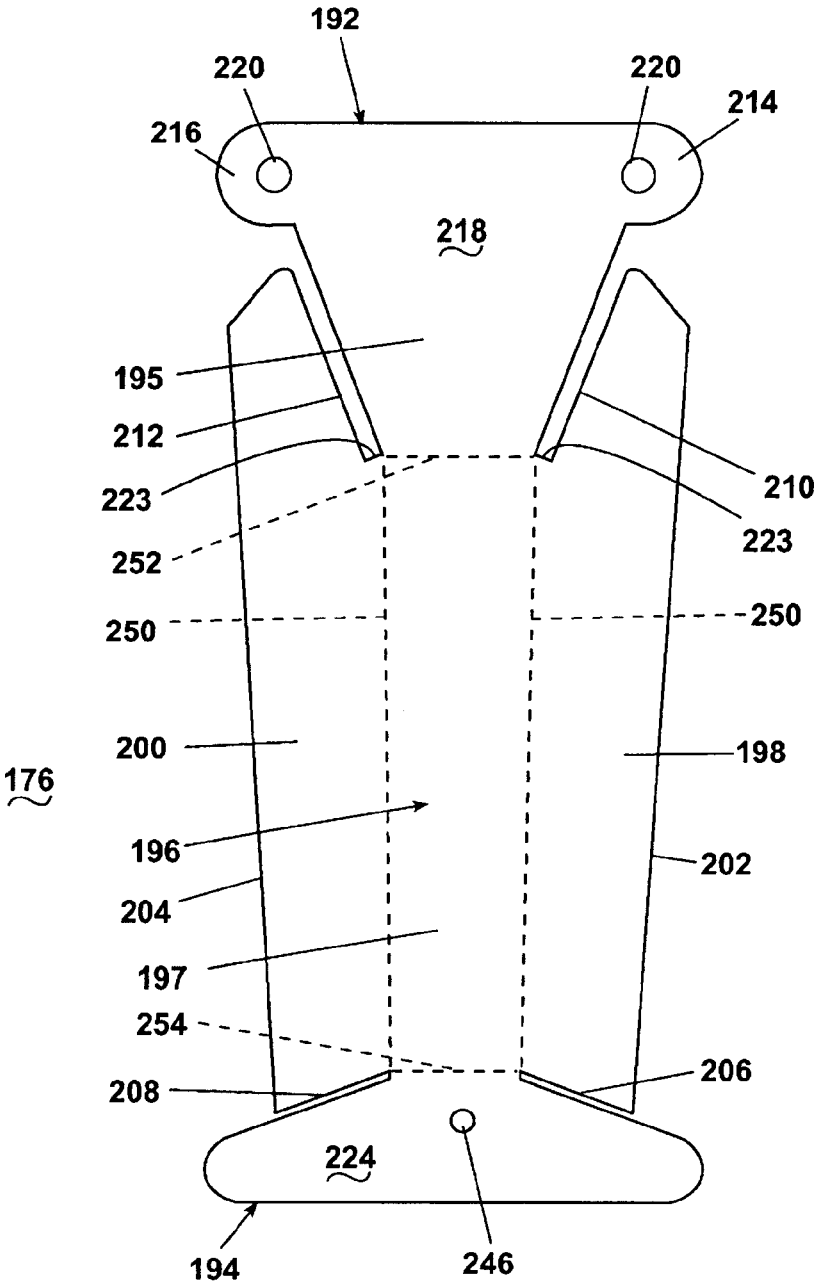
FIG. 17 is a plan view of a pattern for fabricating the leg shown in FIG. 12 from metal plate.

FIGS. 12–15 illustrate the leg 176 for use with the circular windband hoop 172. FIG. 16 illustrates the leg 186 for use with the square hoop 182. FIG. 17 illustrates a pattern for fabricating both the legs 176, 186. The leg 176, 186 is a hollow elongated member comprising a standard 190 transitioning to a mounting flange 192 at an upper end thereof and a foot 194 at a lower end thereof. The legs 176, 186 are identical except for the curvature of the mounting flange 192 as hereinafter disclosed, and are preferably fabricated from metal flat stock, such as 2 mm steel plate.

The standard 190 comprises a back wall 196 comprising an upper portion 195 having the general shape of an inverted truncated triangle connected to a trapezoidal-shaped planar lower portion 197, a first sidewall 198, and a second sidewall 200. The first sidewall 198 comprises a longitudinal edge 202 along an outer portion thereof, a transverse edge 206 at a lower portion thereof, and an inclined edge 210 along a rear portion thereof inclined downwardly away from the longitudinal edge 202. The second sidewall 200 comprises a longitudinal edge 204 along an outer portion thereof, a transverse edge 208 at a lower portion thereof, and an inclined edge 212 along a rear portion thereof inclined downwardly away from the longitudinal edge 204. As hereinafter disclosed in greater detail, the sidewalls 198, 200 extend outwardly from the back wall 196 to be joined along the longitudinal edges 202, 204 to form the standard 190 having a triangular cross-section.

The mounting flange 192 comprises an extension of the upper portion 195 having a pair of ears 214, 216 extending transversely of the upper portion 195 in spaced-apart juxtaposition. The ears 214, 216 are provided with mounting apertures 220 therethrough and generally centered therein. The mounting flange 192 and the upper portion 195 define an obverse contact surface 218, which transitions uniformly from a planar shape at its junction with the lower portion 197 to an arcuate shape at the mounting flange 192. The arcuate shape of the mounting flange 192 is adapted so that the contact surface 218 is in communication with the inside surface 28, 154.

The foot 194 comprises a generally truncated triangular-shaped extension of the lower portion 197 of the back wall 196 having top surface 224 and a bottom surface 226, and provided with a drain hole 246 through the upper middle thereof. The foot 194 is oriented relative to the standard 190 so that the top surface 224 is in contact with the transverse edges 206, 208.

Figure 14:
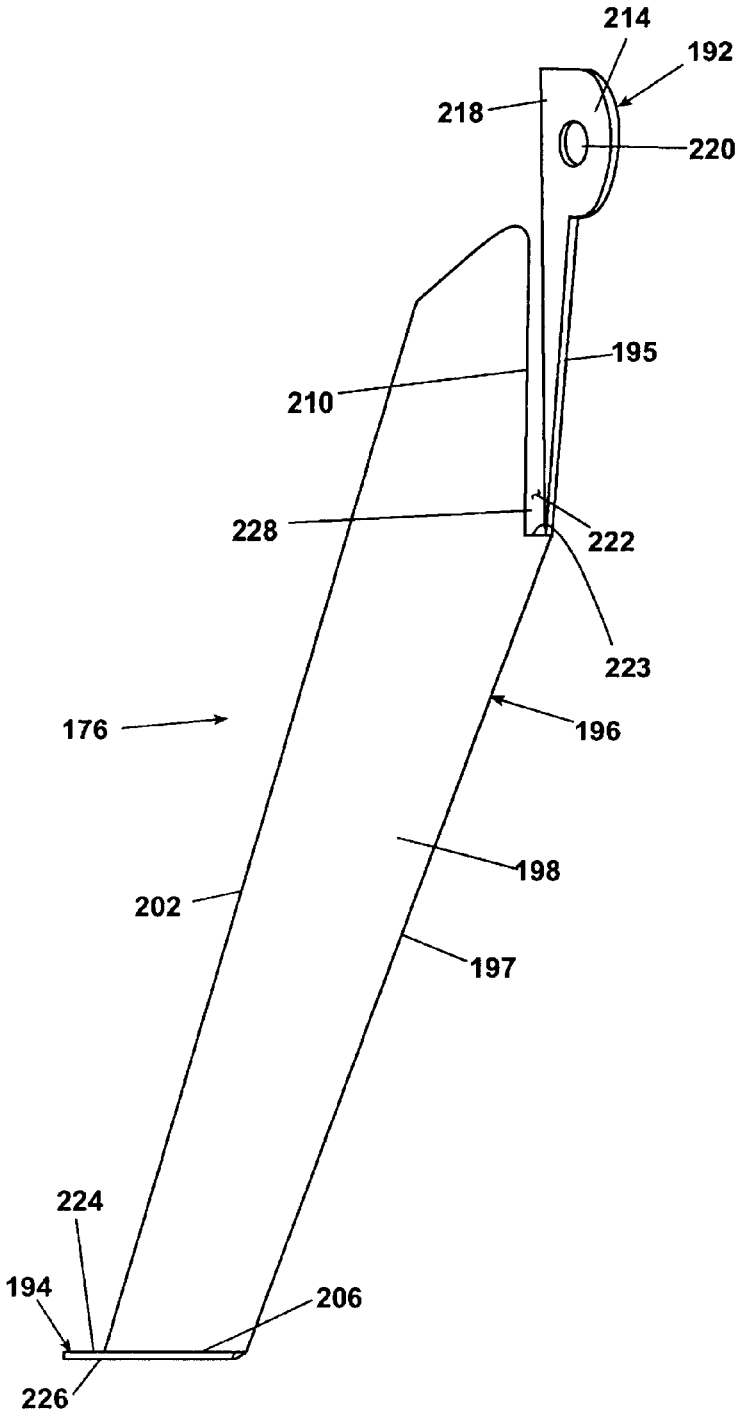
FIG. 14 is a side elevational view of the leg shown in FIG. 12.
Figure 15:
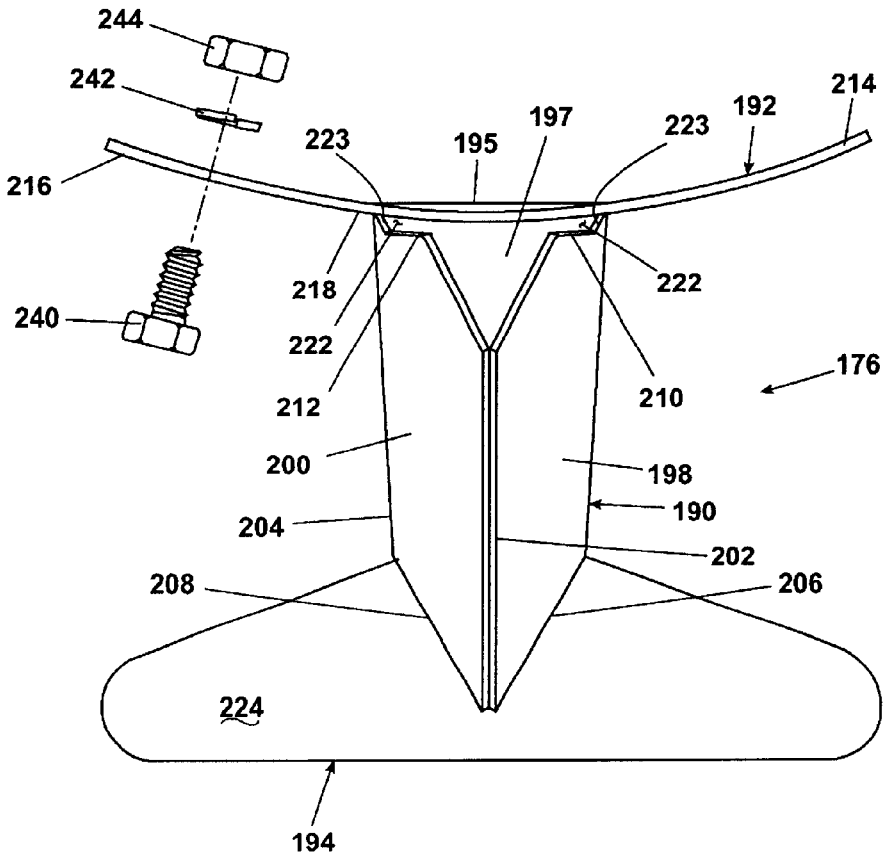
FIG. 15 is a top plan view of the leg shown in FIG. 12.

Referring now to FIG. 17, an exemplary pattern is shown for fabricating the leg 176, 186 from metal plate, such as steel. Preferably, the leg 176, 186 is fabricated utilizing conventional stamping and forming processes. As previously described, the standard 190 is formed by folding the sidewalls 198, 200 forward (i.e. toward the viewer in the view shown in FIG. 18) along the fold lines 250 so that the longitudinal edges 202, 204 are brought into contact. Preferably, the longitudinal edges 202, 204 are secured together by a conventional fillet weld along the edges 202, 204. The foot 194 is folded forward along the lower transverse fold line 254 so that the transverse edges 206, 208 are in contact with the top surface 224. Preferably, a conventional fillet weld is provided along the junction of the transverse edges 206, 208 and the top surface 224 in order to secure the foot 194 to the standard 190. The upper portion 195 is folded forward along the upper transverse fold line 252 so that the upper portion 195 is generally parallel to the inclined edges 210, 212, as shown in FIG. 14, to form a slot 222, having a lower slot edge or shoulder 223 at a terminal end 228 thereof. Preferably, the slot 222 will be formed to slidably receive the hoops 172, 182 in a partial interference fit with the bottom edge 26 . The upper portion 195 and the mounting flange 192 are also formed to transition from a planar shape at the fold line 252 to an arcuate shape at the mounting flange 192, as shown more clearly in FIGS. 15 and 16, respectively. It will be understood that the aforementioned fabrication steps are applicable to both the legs 176, 186. As shown in FIG. 14, as so fabricated, the standard 190 will be inclined relative to the foot 194, which will be supported by the bottom surface 226 in contact with a support surface (not shown), and the slot 222 will be generally orthogonal to the foot 194.

In the preferred embodiment, the overall length of the pattern is 13 inches, the width of the mounting flange 192 is 5¾ inches, and the width of the foot 194 is 5¾ inches. The distance from the front of the foot 194 to the lower transverse fold line 254 is 1⅝ inches, the distance from the top of the mounting flange 192 to the upper transverse fold line 252 is 4 inches, the length of the lower transverse fold line 254 is 1⅜ inches, and the length of the upper transverse fold line 252 is 1¾ inches. The length of the-transverse edges 206, 208 is 1.463 inches. The inclined edges 210, 212 are inclined 70° elative to the upper transverse fold line 252. The transverse edges 206, 208 are inclined 20° relative to the lower transverse fold line 254.

Referring again to FIGS. 10 and 11, the legs 176, 186 are attached to the hoops 172, 182, respectively, by sliding the hoops 172, 182 into the slots 222 so that the mounting flange 192 is received in the center opening 58, 122, the contact surface 218 is in slidable communication with the inside surfaces 28, 154 and the hoops 172, 182 are supported in the slots 222 on the slot edges 223. The legs 176, 186 are secured to the hoops 172, 182 by threaded fasteners, such as the bolts 240 inserted through the mounting slots 230, 232 in the hoops 172, 182, and the mounting apertures 220 in cooperative alignment therewith. The bolts 240 are preferably secured with the lockwashers 242 and the threaded nuts 244.

As so assembled, the legs 176, 186 will extend outwardly of the, hoops 172, 182 to be supported upon the feet 194 so that the weight of the cooking pot 14 will be distributed through the pot supports 114, 174 to the hoops 172, 182, through the standards 190 and the feet 194, to the support surface on which the cook stove is supported. With both legs 176, 186, the load is borne entirely by the standards 190 and the feet 194 and not by any connections. The three-sided triangular configuration of the standards 190 results in a structural element having a very high axial and bending strength. The bolted connections are provided simply to keep the legs 176, 186 in proper position and attached to the hoop 172, 182, and do not carry any load. The combination of an interference fit and a bolted leg attachment makes it virtually impossible to improperly assemble the legs 176, 186 to the hoops 172, 182. If the legs are somehow improperly assembled, the cook stove will not be properly supported on the legs, thereby preventing its use. If the legs 176, 186 are improperly bolted to the hoops 172, 182, the stove and the weight that it supports will still be adequately supported by the legs since the load will still be distributed from the hoop 172, 182, through the slot edge 223, and through the standard 190 and foot 194.

Figure 18:
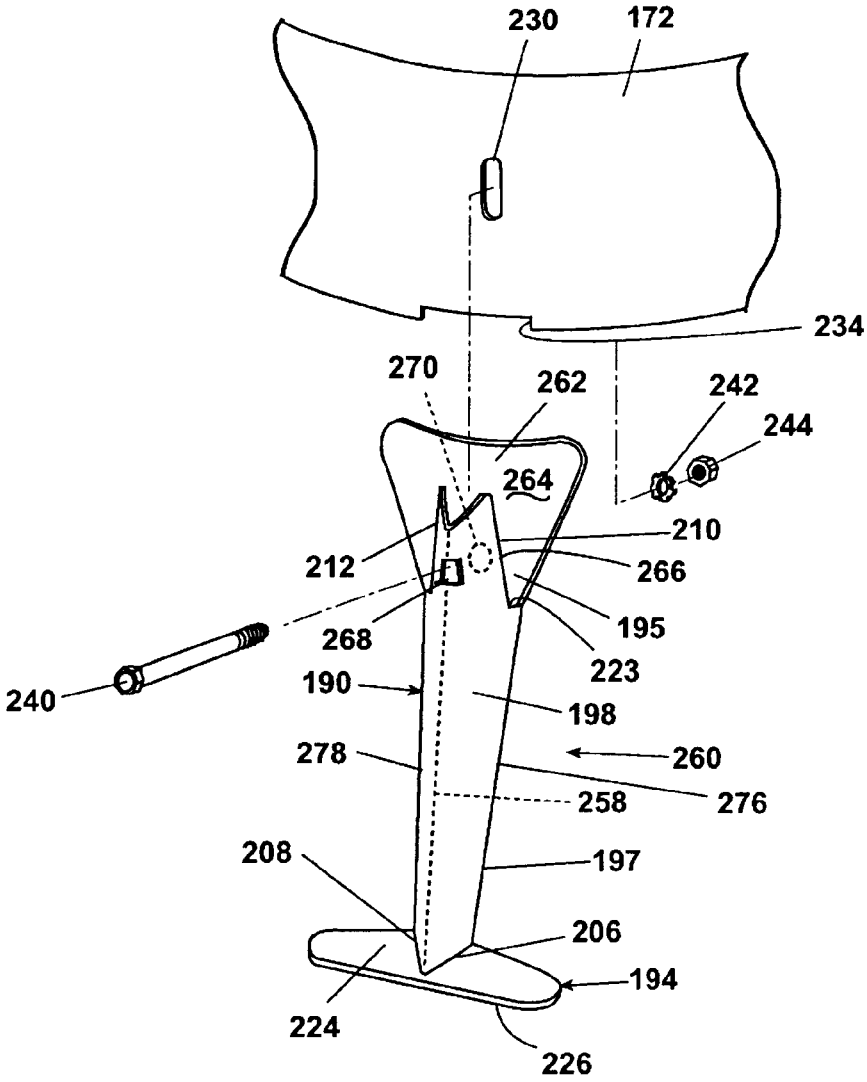
FIG. 18 is a perspective view of a fifth embodiment of the invention comprising alternate embodiments of the portable cook stove of FIG. 10 and the removable leg.
Figure 19:
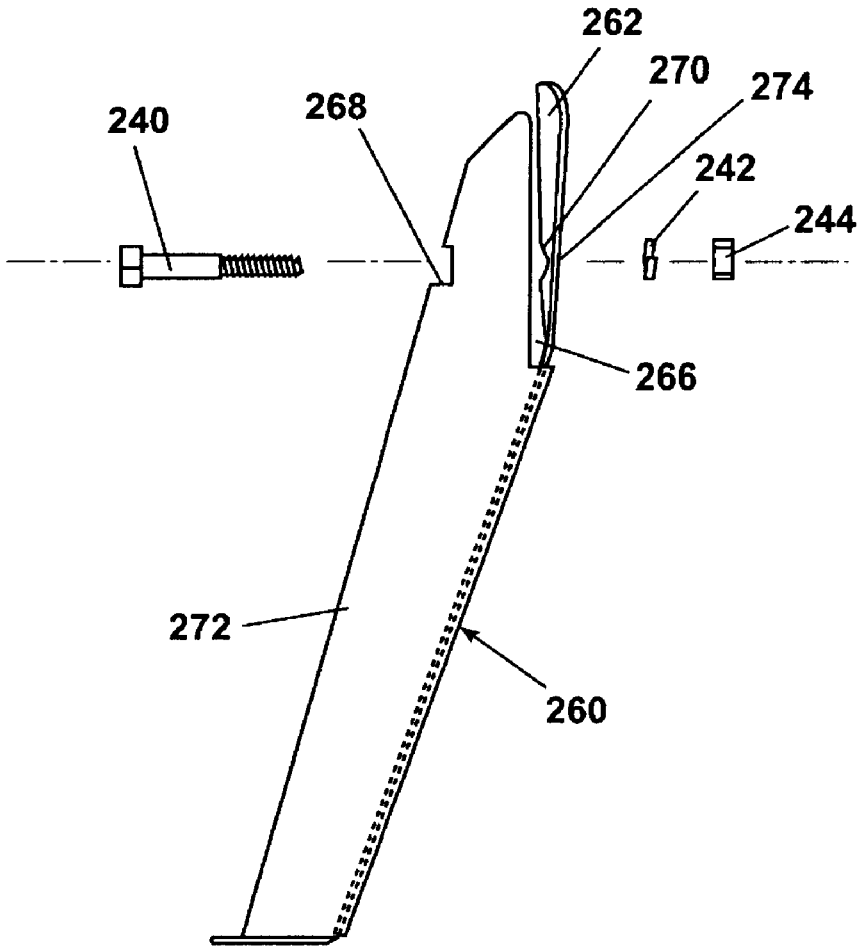
FIG. 19 is a side elevational view of the leg shown in FIG. 18.

FIGS. 18 and 19 illustrate a fifth embodiment of the leg 260 which is identical to the legs 176, 186 except in the mounting flange and the placement of the mounting apertures for attaching the leg 260 to the hoop 172, 182, and its fabrication from two work pieces rather than a single work piece. Thus, like numerals will be used for like elements between these embodiments.

The leg 260 is a hollow elongated member comprising a standard 190 transitioning to a mounting flange 262 at an upper end thereof and a foot 194 at a lower end thereof. The mounting flange 262 comprises a generally triangular shaped extension of the upper portion 195 having an obverse contact surface 264, which transitions uniformly from a planar shape at its junction with the lower portion 197 to an arcuate shape at the mounting flange 262. The arcuate shape of the mounting flange 262 is adapted so that the contact surface 264 is in communication with the inside surface 28, 154 when the foot 260 is attached to the hoop 172, 182.

The circular hoop 172 illustrated in FIG. 18 is identical to the hoop 172 shown in FIG. 10, except that it is provided with a single mounting slot 230 therethrough adapted for alignment with the longitudinal axis of the leg 260 when the leg 260 is attached to the hoop 172, rather than the paired mounting slots shown in FIG. 10. The hoop 172 illustrated in FIG. 18 is also provided with a notch 234 in the bottom edge to receive the slot edges 223 of the slot 266. This notch 234 minimizes any side-to-side movement of the attached leg 260. The square hoop 182 can also be provided with the mounting slot 230 and the notch 234 for attaching the leg 260 as for the hoop 172. The hoop 172, 182 can also be provided without the notch 234.

The standard 190 is fabricated of a first generally elongated work piece 272 bent along a longitudinal fold line 258 into an elongated arcuate wall having a pair of spaced-apart rear edges 276, 278. Alternatively, the first workpiece can be folded into an angular configuration. Referring also to FIG. 17, a second work piece 274 is an elongated member comprising a somewhat triangular-shaped mounting flange 262, a somewhat triangular-shaped foot 194, and a back wall 196 corresponding generally in shape to the pattern shown in FIG. 17 with the sidewalls 198, 200 removed along the longitudinal fold lines 250. The first work piece 272 is fixedly attached to the second work piece 274 by joining the rear edges 276, 278 to the edges of the back wall 196 (corresponding to the longitudinal fold lines 250 shown in FIG. 17), such as by spot welding or continuous welding. The foot 194 is folded against the lower transverse edges 206, 208 and secured thereto as previously disclosed for the legs 176, 186. The mounting flange 262 is folded and formed into a curve as previously disclosed for the legs 176, 186 to form the leg 260 and a slot 266.

A generally rectilinear front mounting slot 268 intersects the longitudinal fold line 258 coaxial with a rear mounting aperture 270 extending through the mounting flange 262. A single bolt 240 is inserted through the mounting slot 268 and the mounting aperture 270 and a cooperating mounting slot in the hoop 172, 182 to secure the leg 260 to the hoop 172, 182 in a manner similar to the attachment of the leg 176, 186 to the hoop 172, 182. The mounting slot 268 is adapted to hold the head of the bolt 240 to enable the nut 244 to be tightened without the necessity of holding the bolt head with a wrench.

The fifth embodiment 260 of the leg provides for easy consumer assembly since only a single bolt is used per leg. No vertical stress is carried by the horizontal bolts. Thus, there is virtually no possibility of sheared or broken bolts during normal use. Since the bolt extends through the standard in addition to the mounting flange, the legs cannot buckle away from the hoop, nor can they buckle under the hoop. The locking leg design and wide foot pad provide a very stable cook stove on a variety of support surfaces, and make the cook stove virtually impossible to overturn during use. Finally, the entire disassembled cook stove unit packs inside a very small carton. Approximately 960 cook stove units can be packed into a 40-foot HC ocean container.

Unless specifically claimed otherwise, it will be understood that all structural and dimensional values (including lengths, widths, heights, thicknesses, angles, number of elements, etc.) provided herein are for the purposes of illustrating the preferred embodiment of the invention and should not be construed as limiting on the invention.

While the invention has been specifically described in connection with certain specific embodiments thereof, it is to be understood that this is by way of illustration and not of limitation. Reasonable variation and modification are possible within the scope of the foregoing disclosure and drawings without departing from the spirit of the invention.

What is claimed is:

1. A portable cook stove adapted for supporting a cooking pot thereon, comprising:

a wall having a closed hoop configuration defining a periphery, wherein the wall defines a central opening therethrough;

at least one cooking pot support mounted to the wall in a generally transverse orientation to the wall and extending into the central opening, the at least one cooking pot support defining a cooking pot support surface for supporting the cooking pot thereon;

a burner mounted to the wall in a generally coaxial configuration with the central opening, the burner adapted to be operably interconnected with a source of fuel;

a plurality of mounting portions mounted to at least one of the wall and the at least one cooking pot support in spaced locations around the periphery of the wall;

a plurality of ground-engaging legs connected to the mounting portions; and wherein one of a lower surface of the wall and an upper portion of the plurality of legs has a mounting opening with a terminal end thereon adapted to receive the other of the lower surface of the wall and the upper portion of the plurality of legs when the plurality of legs are mounted to the mounting portions, and wherein the one of the lower surface of the wall and the upper portion of the plurality of legs can abut and receive reinforcement from the terminal end of the mounting opening when a force is imposed on the cooking pot support surface.

2. The portable cook stove according to claim 1 wherein the plurality of legs are inclined at a predetermined acute angle outwardly with respect to the wall so that a load on the cooking pot support surface will urge the legs to deflect angularly outwardly and provide additional support to the portable cook stove and a more stable base for the cooking pot to prevent tipping thereof.

3. The portable cook stove according to claim 1 wherein the plurality of legs are detachable from the mounting portions.

4. The portable cook stove according to claim 3 wherein the mounting portions further comprise nuts and the plurality of legs are threaded coaxially therein.

5. The portable cook stove according to claim 3 wherein the plurality of legs further comprise a shoulder which receives a bottom edge of the wall.

6. The portable cook stove according to claim 3 wherein the plurality of legs further comprise flanges with at least one mounting aperture therethrough, and are further attached to the wall via at least one fastener extending through thee mounting apertures.

7. The portable cook stove according to claim 6 wherein the plurality of legs further comprise standards and at least one aperture extending through the standards, and are father attached to the wall via at least one fastener extending through the mounting apertures.

8. The portable cook stove according to claim 6 wherein a lower edge of the wall has a groove in register with each of the plurality of the ground-engaging legs and the mounting portion is received within the groove to minimize side-to-side and rocking movement of the corresponding leg with respect to the wall.

9. The portable cook stove according to claim 3 wherein the mounting opening and the terminal end are on the legs and comprise a v-shaped opening having a shoulder.

10. The portable cook stove according to claim 1 wherein the wall is a rounded rectangular shape.

11. The portable cook stove according to claim 1 wherein the wall is circular.

12. The portable cook stove according to claim 1 wherein the at least one cooking pot support is a v-shaped brace mounted to an interior surface of the wall.

13. The portable cook stove according to claim 1 wherein the plurality of legs have feet thereon.

14. The portable cook stove according to claim 1 wherein the fuel is a gas.

15. The portable cook stove according to claim 14 wherein the gas is natural gas.

16. The portable cook stove according to claim 14 where in the gas is propane.

17. The portable cook stove according to claim 1 wherein the wall has top and bottom edges, and wherein the wall engages each of the plurality of legs at a point intermediate the top and bottom edges whereby the engagement resists the outer deflection of each of the plurality of legs during loading of the portable cook stove.

18. The portable cook stove according to claim 1 wherein the burner is positioned at the mid-height of the wall to maximize the diversion of wind away from the burner.

19. A method of packaging a portable cook stove comprising the steps of:

providing a carton of a predetermined size;

providing a portable cook stove in a disassembled state comprising: a wall having a closed hoop configuration having a top edge and a bottom edge and defining a central opening therethrough having a plurality of cooking pot supports mounted to the wall adjacent the top edge thereof and extending into the central opening, a plurality of legs, a cooking pot defining a cooking chamber therein, a burner adapted to be mounted to the wall, and hardware for attachment purposes;

inverting the wall so that the cooking pot supports comprise a floor portion adjacent the bottom edge of the inverted wall;

placing the inverted wall inside the carton;

placing the cooking pot within the central opening inside the inverted wall atop the cooking pot supports;

placing the legs, the burner, and the hardware inside the cooking chamber of the cooking pot; and closing the carton;

whereby the carton can be sealed and shipped to a desired location and the packaged portable cook stove occupies less space than a portable cook stove packaged utilizing conventional packaging methods.

20. The method according to claim 18 and further comprising the step of placing packing materials around the components in the carton to prevent damage to the components in the carton during shipping.

21. The method according to claim 18 and further comprising the step of unpacking the carton and assembling the portable cook stove.

22. The method according to claim 18 and further comprising the step of loading a plurality of cartons packaged according to the method of claim 16 into a standard shipping container for delivery.

* * * * *